US008067345B2

(12) United States Patent
Tokiai et al.

(10) Patent No.: US 8,067,345 B2
(45) Date of Patent: Nov. 29, 2011

(54) REFRIGERATOR OIL COMPOSITION

(75) Inventors: Takeo Tokiai, Chiba (JP); Masato Kaneko, Chiba (JP); Hiroaki Koshima, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 253 days.

(21) Appl. No.: 12/513,673

(22) PCT Filed: Nov. 5, 2007

(86) PCT No.: PCT/JP2007/071481

§ 371 (c)(1),
(2), (4) Date: May 6, 2009

(87) PCT Pub. No.: WO2008/056629

PCT Pub. Date: May 15, 2008

(65) Prior Publication Data

US 2010/0029522 A1 Feb. 4, 2010

(30) Foreign Application Priority Data

Nov. 6, 2006 (JP) ..... 2006-300738

(51) Int. Cl.

| | |
|---|---|
| ***C10M 169/04*** | (2006.01) |
| ***C10M 105/38*** | (2006.01) |
| ***C10M 101/04*** | (2006.01) |
| ***C08G 63/00*** | (2006.01) |

(52) U.S. Cl. ..... 508/208; 508/485; 508/486; 508/494

(58) Field of Classification Search ..... 508/579, 508/485, 486, 494

See application file for complete search history.

(56) References Cited

U.S. PATENT DOCUMENTS

| | | | | |
|---|---|---|---|---|
| 5,648,016 | A | 7/1997 | Klug et al. | |
| 2001/0011716 | A1* | 8/2001 | Kaneko et al. | 252/68 |
| 2001/0012821 | A1* | 8/2001 | Koishikawa et al. | 508/416 |
| 2008/0096775 | A1 | 4/2008 | Kasai | |

FOREIGN PATENT DOCUMENTS

| | | |
|---|---|---|
| EP | 1 211 302 A1 | 6/2002 |
| JP | 59 025890 | 2/1984 |
| JP | 7 507342 | 8/1995 |
| JP | 9-176668 | 7/1997 |
| JP | 10 265790 | 10/1998 |
| JP | 11 012591 | 1/1999 |
| JP | 11 181466 | 7/1999 |
| JP | 11 315295 | 11/1999 |
| JP | 2001 214186 | 8/2001 |
| JP | 2006-36850 | 2/2006 |
| JP | 2006 503961 | 2/2006 |
| JP | 2006 282778 | 10/2006 |

OTHER PUBLICATIONS

Extended European Search Report issued on Mar. 8, 2011 in the corresponding European Application No. 07831213.9.

* cited by examiner

*Primary Examiner* — Walter Griffin
*Assistant Examiner* — Francis C Campanell
(74) *Attorney, Agent, or Firm* — Oblon, Spivak, McClelland, Maier & Neustadt, L.L.P.

(57) ABSTRACT

A refrigerator oil composition includes: a synthetic base oil; and a partial hydrocarbyl ether of an aliphatic polyhydric alcohol condensate, in which the aliphatic polyhydric alcohol condensate includes a condensate of 4 to 20 molecules of a hindered glycol and/or an aliphatic polyhydric alcohol having 3 to 6 hydroxyl groups. The refrigerator oil composition is preferably used in a compression refrigerator that uses a hydrofluorocarbon, a natural refrigerant such as a hydrocarbon, carbon dioxide, or ammonia, a mixed refrigerant of fluoroiodomethane and propene, an unsaturated fluorinated hydrocarbon, a fluorinated ether, a fluorinated alcohol, a fluorinated ketone, or a mixture thereof as a refrigerant, has a low coefficient of friction, and is excellent in energy-saving property.

15 Claims, No Drawings

REFRIGERATOR OIL COMPOSITION

TECHNICAL FIELD

The present invention relates to a refrigerator oil composition, and more specifically, to a refrigerator oil composition which has a low coefficient of friction, is excellent in energy saving property, and is suitably used in each of a compression refrigerator and a refrigeration system in various refrigeration fields (such as a car air conditioner, a gas heat pump, an air conditioner, a cold storage, a vending machine, a showcase, a water heater, and a floor heating appliance).

BACKGROUND ART

In general, a compression refrigerator include at least a compressor, a condenser, an expansion mechanism (such as an expansion valve), and an evaporator, and further a drier, and is structured so that a mixed liquid of a refrigerant and lubricating oil (refrigerator oil) circulates in the closed system. In such compression refrigerator, the temperature in the compressor is generally high, and the temperature in the condenser is generally low, though such general theory is not applicable to a certain kind of such compression refrigerator. Accordingly, the refrigerant and the lubricating oil must circulate in the system without undergoing phase separation in a wide temperature range from low temperature to high temperature. In general, the refrigerant and the lubricating oil have regions where they undergo phase separation at low temperature and high temperature. Moreover, the highest temperature of the region where the refrigerant and the lubricating oil undergo phase separation at low temperature is preferably −10° C. or lower, or particularly preferably −20° C. or lower. On the other hand, the lowest temperature of the region where the refrigerant and the lubricating oil undergo phase separation at high temperature is preferably 30° C. or higher, or particularly preferably 40° C. or higher. The occurrence of the phase separation during the operation of the refrigerator adversely affects the lifetime or efficiency of the refrigerator to a remarkable extent. For example, when the phase separation of the refrigerant and the lubricating oil occurs in the compressor portion, a movable part is insufficiently lubricated, with the result that baking or the like occurs to shorten the lifetime of the refrigerator remarkably. On the other hand, when the phase separation occurs in the evaporator, the lubricating oil having a high viscosity is present, with the result that the efficiency of heat exchange reduces.

A chlorofluorocarbon (CFC), a hydrochlorofluorocarbon (HCFC), or the like has been heretofore mainly used as a refrigerant for a refrigerator. However, such compounds each contain chlorine that is responsible for environmental issues, so investigation has been conducted on a chlorine-free alternative refrigerant such as a hydrofluorocarbon (HFC). A hydrofluorocarbon typified by, for example, 1,1,1,2-tetrafluoroethane, difluoromethane, pentafluoroethane, or 1,1,1-trifluoroethane (hereinafter referred to as "R134a", "R32", "R125", or "R143a", respectively) has been attracting attention, and, for example, R134a has been used in a car air conditioner system.

However, the HFC may also be involved in global warming, so the so-called natural refrigerant such as carbon dioxide, a mixed refrigerant of fluoroiodomethane and propene, ether, or the like has been attracting attention as an alternative refrigerant additionally suitable for environmental protection.

Further, in recent years, an unsaturated fluorinated hydrocarbon compound (see, for example, Patent Document 1), a fluorinated ether compound (see, for example, Patent Document 2), a fluorinated alcohol compound, a fluorinated ketone compound, or the like has been found to be a refrigerant which: has a global warming potential lower than that of R134a described above; and can be used in a current car air conditioner system.

By the way, in the field of air conditioning, investigation has been recently conducted on a reduction in viscosity of refrigerator oil or an improvement in frictional characteristic of the oil in lubrication with a view to saving energy consumed by a refrigerator.

The energy-saving property of, for example, a refrigerator for a cold storage has been improved by reducing the viscosity of refrigerator oil to VG32, 22, 15, or 10. However, an additional reduction in viscosity has involved the emergence of problems such as reductions in sealing property and lubricity of the oil.

For example, (1) a refrigerator oil composition obtained by blending base oil composed of synthetic oil with at least one kind which: is selected from (A) an etherified product of a trivalent to hexavalent aliphatic polyhydric alcohol and (B) an etherified product of a bimolecular or termolecular condensate of a trivalent to hexavalent aliphatic polyhydric alcohol; and has a kinematic viscosity of 5 to 200 $mm^2/s$ at 40° C. (see, for example, Patent Document 3), and (2) a refrigerator oil composition obtained by blending base oil composed of mineral oil and/or synthetic oil with a glyceryl ether compound represented by the following general formula (I) at 0.01 to 10% by wt with reference to the total amount of the composition (see, for example, Patent Document 4) have been disclosed as refrigerator oil compositions each of which: is used in a compression refrigerator in which, for example, a hydrofluorocarbon-based, ether-based, hydrocarbon-based, carbon dioxide-based, or ammonia-based natural refrigerant is used as a refrigerant; and has improved lubricating performance:

$$R^1—OCH_2CH(OH)CH_2OH \quad (I)$$

where $R^1$ represents an alkyl group having 10 to 22 carbon atoms.

The refrigerator oil composition (1) has been investigated while emphasis is placed mainly on abrasion resistance and the property with which the clogging of a capillary is prevented, and the refrigerator oil composition (2) has been investigated while emphasis is placed mainly on abrasion resistance. However, no investigation has been conducted on the energy-saving property of each of the compositions.

Patent Document 1: JP 2006-503961 A
Patent Document 2: JP 7-507342 A
Patent Document 3: JP 10-265790 A
Patent Document 4: JP 11-315295 A

DISCLOSURE OF THE INVENTION

Problem to be solved by the Invention

In view of the above-mentioned circumstances, it is an object of the present invention to provide a refrigerator oil composition which is preferably used in a compression refrigerator that uses a hydrofluorocarbon, a natural refrigerant such as a hydrocarbon, carbon dioxide, or ammonia, a mixed refrigerant of fluoroiodomethane and propene, an unsaturated fluorinated hydrocarbon, a fluorinated ether, a fluorinated alcohol, a fluorinated ketone, or a mixture thereof as a refrigerant, has a low coefficient of friction, and is excellent in energy-saving property.

Means for Solving the Problems

The inventors of the present invention have made extensive studies with a view to developing the refrigerator oil composition having a low coefficient of friction and excellent in energy-saving property. As a result, the inventors have found that a refrigerator oil composition containing a synthetic base oil and a partial hydrocarbyl ether of a specific aliphatic polyhydric alcohol condensate can qualify for the object. The present invention has been completed on the basis of such finding.

That is, the present invention provides:

(1) a refrigerator oil composition, including a synthetic base oil; and a partial hydrocarbyl ether of an aliphatic polyhydric alcohol condensate, in which the aliphatic polyhydric alcohol condensate includes a condensate of 4 to 20 molecules of a hindered glycol and/or an aliphatic polyhydric alcohol having 3 to 6 hydroxyl groups;

(2) a refrigerator oil composition according to item (1), in which the synthetic base oil includes at least one kind selected from a polyvinyl ether-based compound, a polyoxyalkylene glycol-based compound, a polycarbonate-based compound, and a polyol ester-based compound;

(3) a refrigerator oil composition according to item (1) or (2), in which the synthetic base oil has a molecular weight of 150 to 5,000;

(4) a refrigerator oil composition according to any one of items (1) to (3), in which the partial hydrocarbyl ether of the aliphatic polyhydric alcohol condensate comprises a monoether;

(5) a refrigerator oil composition according to any one of items (1) to (4), in which the partial hydrocarbyl ether of the aliphatic polyhydric alcohol condensate includes a monoether;

(6) a refrigerator oil composition according to any one of items (1) to (5), in which a hydrocarbyl group of which a hydrocarbyl ether portion in the partial hydrocarbyl ether of the aliphatic polyhydric alcohol condensate is constituted includes an alkyl or alkenyl group having 3 to 25 carbon atoms;

(7) a refrigerator oil composition according to any one of items (1) to (6), in which a content of the partial hydrocarbyl ether of the aliphatic polyhydric alcohol condensate is 0.1 to 10% by mass with reference to a total amount of the composition;

(8) a refrigerator oil composition according to any one of items (1) to (7), further comprising at least one kind of an additive selected from an extreme pressure agent, an oiliness agent, an antioxidant, an acid scavenger, a copper deactivator, and an anti-foaming agent; and (9) a refrigerator oil composition according to any one of items (1) to (8), in which the composition has a kinematic viscosity of 1 to 500 $mm^2/s$ at 40° C., a volume specific resistance of $10^9$ Ω·cm or more, and a coefficient of friction by a reciprocating dynamic friction test of 0.115 or less.

EFFECTS OF THE INVENTION

According to the present invention, there can be provided a refrigerator oil composition which: is preferably used in a compression refrigerator that uses a hydrofluorocarbon, a natural refrigerant such as a hydrocarbon, carbon dioxide, or ammonia, a mixed refrigerant of fluoroiodomethane and propene, an unsaturated fluorinated hydrocarbon, a fluorinated ether, a fluorinated alcohol, a fluorinated ketone, or a mixture thereof as a refrigerant; has a low coefficient of friction; and is excellent in energy-saving property.

BEST MODE FOR CARRYING OUT THE INVENTION

A refrigerator oil composition of the present invention contains a synthetic base oil and a partial hydrocarbyl ether of an aliphatic polyhydric alcohol condensate, and is characterized in that the aliphatic polyhydric alcohol condensate is a condensate of 4 to 20 molecules of a hindered glycol and/or an aliphatic polyhydric alcohol having 3 to 6 hydroxyl groups.

In the refrigerator oil composition of the present invention, synthetic base oil such as an oxygen-containing compound including a polyvinyl ether-based compound, a polyoxyalkylene glycol-based compound, a polycarbonate-based compound, or a polyol ester-based compound is used as base oil.

[Polyvinyl Ether-Based Compound]

Polyvinyl ether-based compounds each used as base oil in the present invention are classified into a compound obtained by polymerizing a vinyl ether monomer (hereinafter referred to as "Polyvinyl Ether I"), a compound obtained by copolymerizing a vinyl ether monomer and a hydrocarbon monomer having an olefinic double bond (hereinafter referred to as "Polyvinyl Ether Copolymer II"), and a copolymer of polyvinyl ether, and an alkylene glycol or a poly(oxy)alkylene glycol, or a monoether of each of the glycols (hereinafter referred to as "Polyvinyl Ether Copolymer III").

Examples of the vinyl ether monomers used as the raw material of the Polyvinyl Ether I include: vinyl methyl ether, vinyl ethyl ether, vinyl-n-propyl ether, vinyl-isopropyl ether, vinyl-n-butyl ether, vinyl-isobutyl ether, vinyl-sec-butyl ether, vinyl-tert-butyl ether, vinyl-n-pentyl ether, vinyl-n-hexyl ether, vinyl-2-methoxyethyl ether, vinyl-2-ethoxyethyl ether, vinyl-2-methoxy-1-methylethyl ether, vinyl-2-methoxy-propyl ether, vinyl-3,6-dioxaheptyl ether, vinyl-3,6,9-trioxadecyl ether, vinyl-1,4-dimethyl-3,6-dioxaheptyl ether, vinyl-1,4,7-trimethyl-3,6,9-trioxadecyl ether, vinyl-2,6-dioxa-4-heptyl ether, and vinyl-2,6,9-trioxa-4-decyl ether; 1-methoxypropene, 1-ethoxypropene, 1-n-propoxypropene, 1-isopropoxypropene, 1-n-butoxypropene, 1-isobutoxypropene, 1-sec-butoxypropene, 1-tert-butoxypropene, 2-methoxypropene, 2-ethoxypropene, 2-n-propoxypropene, 2-isopropoxypropene, 2-n-butoxypropene, 2-isobutoxypropene, 2-sec-butoxypropene, and 2-tert-butoxypropene; 1-methoxy-1-butene, 1-ethoxy-1-butene, 1-n-propoxy-1-butene, 1-isopropoxy-1-butene, 1-n-butoxy-1-butene, 1-isobutoxy-1-butene, 1-sec-butoxy-1-butene, 1-tert-butoxy-1-butene, 2-methoxy-1-butene, 2-ethoxy-1-butene, 2-n-propoxy-1-butene, 2-isopropoxy-1-butene, 2-n-butoxy-1-butene, 2-isobutoxy-1-butene, 2-sec-butoxy-1-butene, 2-tert-butoxy-1-butene, 2-methoxy-2-butene, 2-ethoxy-2-butene, 2-n-propoxy-2-butene, 2-isopropoxy-2-butene, 2-n-butoxy-2-butene, 2-isobutoxy-2-butene, 2-sec-butoxy-2-butene, and 2-tert-butoxy-2-butene. Those vinyl ether-based monomers can be produced by any known methods.

One kind of those vinyl ether monomers may be used alone, or two or more kinds thereof may be used in combination.

Examples of the vinyl ether monomer to be used as a raw material for Polyvinyl Ether Copolymer II include examples similar to those described for the above vinyl ether monomer. One kind of those vinyl ether monomers may be used alone, or two or more kinds thereof may be used in combination.

Further, examples of the hydrocarbon monomer having an olefinic double bond to be used as another raw material include ethylene, propylene, various butenes, various pentenes, various hexenes, various heptenes, various octenes, diisobutylene, triisobutylene, styrene, α-methylstyrene, and various alkyl-substituted styrenes.

One kind of those hydrocarbon monomers each having an olefinic double bond may be used alone, or two or more kinds thereof may be used in combination. In addition, Polyvinyl Ether Copolymer II may be either a block copolymer or a random copolymer.

Each of Polyvinyl Ether I and Polyvinyl Ether Copolymer II can be produced by, for example, the following method.

For initiating the polymerization, any of combinations of Broensted acids, Lewis acids, or organic metal compounds and adducts of carboxylic acid with water, alcohols, phenols, acetals, or vinyl ethers can be used. Examples of the Broensted acids include hydrofluoric acid, hydrochloric acid, hydrobromic acid, hydroiodic acid, nitric acid, sulfuric acid, trichloroacetic acid, and trifluoroacetic acid. Examples of the Lewis acids include boron trifluoride, aluminum trichloride, aluminum tribromide, tin tetrachloride, zinc dichloride, and ferric chloride. Of those Lewis acids, boron trifluoride is particularly preferable. In addition, examples of the organic metal compounds include diethyl aluminum chloride, ethyl aluminum chloride, and diethyl zinc.

When any of water, alcohols, or phenols are used, a hydrogen atom binds to the end of the polymer for polymerization initiation. In contrast, when an acetal is used, a hydrogen atom or one of alkoxy groups of the acetal used can be detached. In addition, when an adduct of vinyl ether with carboxylic acid is used, an alkyl carbonyloxy group originated from a carboxylic acid portion is detached from the adduct of the vinyl ether with the carboxylic acid.

On the other hand, when any of water, alcohols, phenols, and acetals is used, the end of the polymer for terminating the polymerization becomes acetal, olefin, or aldehyde. In addition, in the case of an adduct of vinyl ether with carboxylic acid, it becomes carboxylic acid ester of hemiacetal. The ends of the polymer thus obtained can be converted into desired groups by a method known in the art. Examples of the desired groups include residues such as saturated hydrocarbon, ether, alcohol, ketone, nitrile, and amide. Of those, the residues such as saturated hydrocarbon, ether, and alcohol are preferable.

The polymerization reaction can be initiated at a temperature ranging from −80 to 150° C., usually from −80 to 50° C., depending on the kinds of raw materials and initiators. In addition, the polymerization reaction can be completed within about 10 seconds to 10 hours after initiation of the reaction. This polymerization reaction is usually performed in the presence of a solvent. The solvent may be any of solvents that dissolve the amounts of reaction raw materials required and are inert to the reaction. Examples thereof which can be preferably used include, but not particularly limited to: hydrocarbon solvents such as hexane, benzene, and toluene; and ether solvents such as ethyl ether, 1,2-dimethoxyethane, and tetrahydrofuran.

On the other hand, Polyvinyl Ether Copolymer III can be produced by polymerizing a vinyl ether monomer with an alkylene glycol or a poly(oxy)alkylene glycol, or a monoether of each of the glycols as an initiator in accordance with the above-mentioned polymerization method.

It should be noted that the term "poly(oxy)alkylene glycol" refers to both of a polyalkylene glycol and a polyoxyalkylene glycol.

Examples of the alkylene glycol, poly(oxy)alkylene glycol, or monoether thereof include: alkylene glycols and poly(oxy)alkylene glycols, such as ethylene glycol, diethylene glycol, triethylene glycol, polyethylene glycol, propylene glycol, dipropylene glycol, tripropylene glycol, and polypropylene glycol; and alkylene glycol monoethers and poly(oxy)alkylene glycol monoethers, such as ethylene glycol monomethylether, diethylene glycol monomethylether, triethylene glycol monomethylether, propylene glycol monomethylether, dipropylene glycol monomethylether, and tripropylene glycol monomethylether.

In addition, examples of the vinyl ether monomer to be used as a raw material include examples similar to those described for the vinyl ether monomer in the description of Polyvinyl Ether I. One kind of those vinyl ether monomers may be used alone, or two or more kinds thereof may be used in combination.

In the present invention, one kind of vinyl ether-based compounds may be used alone or two or more thereof may be used in combination.

[Polyoxyalkylene Glycol-Based Compound]

Examples of the polyoxyalkylene glycol-based compound to be used as the base oil in the refrigerator oil composition of the present invention include compounds each represented by a general formula (I):

$$R^1—[(OR^2)_m—OR^3]_n \quad (I)$$

where $R^1$ represents a hydrogen atom, an alkyl group having 1 to 10 carbon atoms, an acyl group having 2 to 10 carbon atoms, or an aliphatic hydrocarbon group having 1 to 10 carbon atoms and 2 to 6 bonding sites, $R^2$ represents an alkylene group having 2 to 4 carbon atoms, $R^3$ represents a hydrogen atom, an alkyl group having 1 to 10 carbon atoms, or an acyl group having 2 to 10 carbon atoms, n represents an integer of 1 to 6, and m represents such a number that an average value for m×n is 6 to 80.

In the above general formula (I), an alkyl group represented by $R^1$ or $R^3$ may be straight-chain, branched, or cyclic. Specific examples of the alkyl group include a methyl group, an ethyl group, an n-propyl group, an isopropyl group, various butyl groups, various pentyl groups, various hexyl groups, various heptyl groups, various octyl groups, various nonyl groups, various decyl groups, a cyclopentyl group, and a cyclohexyl group. When the alkyl group has more than 10 carbon atoms, compatibility with the refrigerant reduces, so the phase separation of the compound and the refrigerant may occur. The alkyl group has preferably 1 to 6 carbon atoms.

In addition, an alkyl group portion of the acyl group represented by $R^1$ or $R^3$ may be straight-chain, branched, or cyclic. Specific examples of the alkyl group portion of the acyl group include various groups each having 1 to 9 carbon atoms described as specific examples of the above alkyl group. When the acyl group has more than 10 carbon atoms, compatibility with the refrigerant reduces, so the phase separation of the compound and the refrigerant may occur. The acyl group has preferably 2 to 6 carbon atoms.

When $R^1$ and $R^3$ each represent an alkyl group or an acyl group, $R^1$ and $R^3$ may be identical to or different from each other.

Further, when n represents 2 or more, multiple $R^3$'s in one molecule may be identical to or different from each other.

When $R^1$ represents an aliphatic hydrocarbon group having 1 to 10 carbon atoms and 2 to 6 bonding sites, the aliphatic hydrocarbon group may be straight-chain or cyclic. Examples of the aliphatic hydrocarbon group having 2 bonding sites include an ethylene group, a propylene group, a butylene group, a pentylene group, a hexylene group, a heptylene group, an octylene group, a nonylene group, a decylene group, a cyclopentylene group, and a cyclohexylene group. In addition, examples of the aliphatic hydrocarbon group having 3 to 6 bonding sites include residues each obtained by removing a hydroxyl group from a polyhydric alcohol such as trimethylolpropane, glycerin, pentaerythritol, sorbitol, 1,2,3-trihydroxycyclohexane, or 1,3,5-trihydroxycyclohexane.

When the aliphatic hydrocarbon group has more than 10 carbon atoms, compatibility with the refrigerant reduces, so the phase separation of the compound and the refrigerant may occur. The aliphatic hydrocarbon group has preferably 2 to 6 carbon atoms.

$R^2$ in the general formula (I) represents an alkylene group having 2 to 4 carbon atoms, and an oxyalkylene group as a repeating unit is, for example, an oxyethylene group, an oxypropylene group, or an oxybutylene group. Oxyalkylene groups in one molecule of the compound may be identical to each other, or may be composed of two or more kinds of oxyalkylene groups; a compound containing at least an oxypropylene unit in anyone of its molecules is preferable, and, in particular, a compound 50 mol % or more of the oxyalkylene units of which are oxypropylene units is suitable.

n in the general formula (I) represents an integer of 1 to 6, and is determined in accordance with the number of bonding sites of $R^1$. For example, when $R^1$ represents an alkyl group or an acyl group, n represents 1, and when $R^1$ represents an aliphatic hydrocarbon group having 2, 3, 4, 5, or 6 bonding site, n represents 2, 3, 4, 5, or 6, respectively. In addition, m represents such a number that an average value for m×n is 6 to 80. When the average value for m×n deviates from the range, the object of the present invention cannot be sufficiently achieved.

The polyoxyalkylene glycol-based compound represented by the general formula (I) includes a polyoxyalkylene glycol having a hydroxyl group at any one of its terminals, and can be suitably used even when the compound contains the hydroxyl group as long as the content of the hydroxyl group is 50 mol % or less with respect to all terminal groups. A content of the hydroxyl group in excess of 50 mol % is not preferable because the moisture-absorbing property of the compound increases, and the viscosity index of the compound reduces.

Polyoxypropylene glycol dimethyl ether, polyoxyethylene, polyoxypropylene glycol dimethyl ether, polyoxypropylene glycol monobutyl ether, polyoxypropylene glycol diacetate, and the like are suitable as such polyoxyalkylene glycols in terms of economical efficiency and effects.

It should be noted that any one of those detailed in Japanese Patent Application Laid-Open No. Hei 2-305893 can be used as the polyoxyalkylene glycol-based compound represented by the above general formula (I).

In the present invention, one kind of those polyoxyalkylene glycol-based compounds may be used alone, or two or more kinds thereof may be used in combination.

[Polycarbonate-Based Compound]

The polycarbonate-based compound to be used as the base oil in the refrigerator oil composition of the present invention is preferably, for example, at least one kind selected from polycarbonates each having two or more carbonate bonds in any one of its molecules, that is, (i) compounds each represented by a general formula (II):

[Chem 1]

$$Z-\{O-\overset{O}{\overset{\|}{C}}-O-[(R^4O)_a-\overset{O}{\overset{\|}{C}}-O]_b-R^5\}_c \quad \text{(II)}$$

where Z represents a residue obtained by removing a hydroxyl group from a c-valent alcohol having 1 to 12 carbon atoms, $R^4$ represents a straight-chain or branched alkylene group having 2 to 10 carbon atoms, $R^5$ represents a monovalent hydrocarbon group having 1 to 12 carbon atoms or a group containing an ether bond represented by $R^7(O-R^6)_d-$ where $R^7$ represents a hydrogen atom or a monovalent hydrocarbon group having 1 to 12 carbon atoms, $R^6$ represents a straight-chain or branched alkylene group having 2 to 10 carbon atoms, and d represents an integer of 1 to 20, a represents an integer of 1 to 30, b represents an integer of 1 to 50, and c represents an integer of 1 to 6, and (ii) compounds each represented by a general formula (III):

[Chem 2]

$$Z-\{O(R^8O)_e-\overset{O}{\overset{\|}{C}}-O-[(R^4O)_a-\overset{O}{\overset{\|}{C}}-O]_b-R^5\}_c \quad \text{(III)}$$

where $R^8$ represents a straight-chain or branched alkylene group having 2 to 10 carbon atoms, e represents an integer of 1 to 20, and Z, $R^4$, $R^5$, a, b, and c each have the same meaning as that described above.

In each of the general formulae (II) and (III), Z, which represents a residue obtained by removing a hydroxyl group from a monovalent to hexavalent alcohol having 1 to 12 carbon atoms, particularly preferably represents a residue obtained by removing a hydroxyl group from a monovalent alcohol having 1 to 12 carbon atoms.

Examples of monovalent to hexavalent alcohols having 1 to 12 carbon atoms for the residue represented by Z are mentioned as follows: as the monovalent alcohols; aliphatic monovalent alcohols such as methyl alcohol, ethyl alcohol, n- or isopropyl alcohol, various butyl alcohols, various pentyl alcohols, various hexyl alcohols, various octyl alcohols, various decyl alcohols, and various dodecyl alcohols; alicyclic monovalent alcohols such as cyclopentyl alcohol and cyclohexyl alcohol; aromatic alcohols such as phenol, cresol, xylenol, butylphenol, and naphthol; and aromatic aliphatic alcohols such as benzyl alcohol and phenetyl alcohol; as the bivalent alcohols: aliphatic alcohols such as ethylene glycol, propylene glycol, butylene glycol, neopentyl glycol, and tetramethylene glycol; alicyclic alcohols such as cyclohexanediol and cyclohexanedimethanol; and aromatic alcohols such as catechol, resorcinol, hydroquinone, and dihydroxy diphenyl; as trivalent alcohols: aliphatic alcohols such as glycerin, trimethylol propane, trimethylol ethane, trimethylol butane, and 1,3,5-pentatriol; alicyclic alcohols such as cyclohexanetriol and cyclohexanetrimethanol; and aromatic alcohols such as pyrogallol and methyl pyrogallol; and as tetravalent to hexavalent alcohols, alipahtic alcohols such as pentaerythritol, diglycerin, triglycerin, sorbitol, and dipentaerythritol.

Examples of such polycarbonate compound include compounds each represented by a general formula (II-a) as a special form of the general formula (II):

[Chem 3]

$$R^9-O-\overset{O}{\overset{\|}{C}}-O-[(R^4O)_a-\overset{O}{\overset{\|}{C}}-O]_b-R^5 \quad \text{(II-a)}$$

where $R^9$ represents a residue obtained by removing a hydroxyl group from a monovalent alcohol having 1 to 12 carbon atoms, and $R^4$, $R^5$, a, and b each have the same meaning as that described above and/or compounds each represented by a general formula (III-a) as a special form of the general formula (III):

[Chem 4]

$$R^9—O(R^8O)_e—\overset{O}{\overset{\|}{C}}—O—[(R^4O)_a—\overset{O}{\overset{\|}{C}}—O]_b—R^5 \quad \text{(III-a)}$$

where $R^4$, $R^5$, $R^8$, $R^9$, a, b, and e each have the same meaning as that described above.

Examples of the residue obtained by removing a hydroxyl group from a monovalent alcohol having 1 to 12 carbon atoms represented by $R^9$ in each of the general formulae (II-a) and (III-a) include: aliphatic hydrocarbon groups such as a methyl group, an ethyl group, an n-propyl group, an isopropyl group, various butyl groups, various pentyl groups, various hexyl groups, various octyl groups, various decyl groups, and various dodecyl groups; alicyclic hydrocarbon groups such as a cyclopentyl group, a cyclohexyl group, a methylcyclohexyl group, a dimethylcyclohexyl group, and a decahydronaphthyl group; aromatic hydrocarbon groups such as a phenyl group, various tolyl groups, various xylyl groups, a mesityl group, and various naphthyl groups; and aromatic aliphatic hydrocarbon groups such as a benzyl group, a methylbenzyl group, a phenethyl group, and various naphthylmethyl groups. Of those, a straight-chain or branched alkyl group having 1 to 6 carbon atoms is preferable.

$R^4$, which represents a straight-chain or branched alkylene group having 2 to 10 carbon atoms, preferably represents a straight-chain or branched alkylene group having 2 to 6 carbon atoms, or particularly suitably represents an ethylene group or a propylene group in terms of, for example, the performance of the compound and the ease with which the compound is produced. Further, $R^5$ represents a monovalent hydrocarbon group having 1 to 12 carbon atoms or a group containing an ether bond represented by $R^7(O—R^6)_d—$ where $R^7$ represents a hydrogen atom or a monovalent hydrocarbon group having 1 to 12, or preferably 1 to 6 carbon atoms, $R^6$ represents a straight-chain or branched alkylene group having 2 to 10 carbon atoms, and d represents an integer of 1 to 20, and examples of the above monovalent hydrocarbon group having 1 to 12 carbon atoms include examples similar to those described in the description of $R^9$. In addition, a straight-chain or branched alkylene group having 2 to 10 carbon atoms represented by $R^6$ is preferably a straight-chain or branched alkylene group having 2 to 6 carbon atoms, or is particularly preferably an ethylene group or a propylene group by the same reason as that in the case of $R^4$.

$R^5$ particularly preferably represents a straight-chain or branched alkyl group having 1 to 6 carbon atoms.

A straight-chain or branched alkylene group having 2 to 10 carbon atoms represented by $R^8$ in the general formula (III-a) is preferably a straight-chain or branched alkylene group having 2 to 6 carbon atoms, or is particularly preferably an ethylene group or a propylene group by the same reason as that in the case of $R^4$.

Such polycarbonate-based compound can be produced by any one of various methods; a target polycarbonate-based compound can be typically produced by causing a carbonate-formable derivative such as a carbonic acid diester or phosgene and an alkylene glycol or a polyalkylene glycol to react with each other in accordance with a known method.

In the present invention, one kind of those polycarbonate-based compounds may be used alone, or two or more kinds thereof may be used in combination.

[Polyol Ester-Based Compound]

An ester of a diol or a polyol having about 3 to 20 hydroxyl groups and an fatty acid having about 1 to 24 carbon atoms is preferably used as the polyol ester-based compound to be used as the base oil in the refrigerator oil composition of the present invention. Here, examples of the diol include ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol, and 1,12-dodecanediol. Examples of the polyol include: polyhydric alcohols such as trimethylolethane, trimethylolpropane, trimethylolbutane, di-(trimethylolpropane), tri-(trimethylolpropane), pentaerythritol, di-(pentaerythritol), tri-(pentaerythritol), glycerin, polyglycerol (composed of 2 to 20 glycerin molecules), 1,3,5-pentanetriol, sorbitol, sorbitan, a sorbitol glycerin condensate, adonitol, arabitol, xylitol, and mannitol; and saccharides such as xylose, arabinose, ribose, rhamnose, glucose, fructose, galactose, mannose, sorbose, cellobiose, maltose, isomaltose, trehalose, sucrose, raffinose, gentianose, and merenditose, and partially etherified products and methyl glucosides of the saccharides. Of those, a hindered alcohol such as neopentyl glycol, trimethylolethane, trimethylolpropane, trimethylolbutane, di-(trimethylolpropane), tri-(trimethylolpropane), pentaerythritol, di-(pentaerythritol), or tri-(pentaerythritol) is a preferable polyol.

The fatty acid may have any number of carbon atoms without any particular limitation; an fatty acid having 1 to 24 carbon atoms is typically used. Of the fatty acids each having 1 to 24 carbon atoms, an fatty acid having 3 or more carbon atoms is preferable, an fatty acid having 4 or more carbon atoms is more preferable, an fatty acid having 5 or more carbon atoms is still more preferable, and an fatty acid having 10 or more carbon atoms is most preferable in terms of lubricity. In addition, an fatty acid having 18 or less carbon atoms is preferable, an fatty acid having 12 or less carbon atoms is more preferable, and an fatty acid having 9 or less carbon atoms is still more preferable in terms of compatibility with the refrigerant.

In addition, the fatty acid may be either a straight-chain fatty acid or a branched fatty acid; the fatty acid is preferably a straight-chain fatty acid in terms of lubricity, or is preferably a branched fatty acid in terms of hydrolytic stability. Further, the fatty acid may be either a saturated fatty acid or an unsaturated fatty acid.

Examples of the fatty acid include: linear or branched pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, and oleic acid; or a neoic acid of which the α-carbon atom is quaternary. More specifically, valeric(n-pentanoic) acid, caproic(n-hexanoic) acid, enanthic(n-heptanoic) acid, caprylic(n-ocatanoic) acid, pelargoic(n-nonanoic) acid, capric(n-decanoic) acid, oleic (cis-9-octadecenoic) acid, isopentanoic(3-methylbutanoic) acid, 2-methylhexanoic acid, 2-ethylpentanoic acid, 2-ethylhexanoic acid, and 3,5,5-trimethylhexanoic acid are preferably mentioned.

It should be noted that the polyol ester may be a partial ester in which some of the hydroxyl groups of a polyol remain without being esterified, may be a complete ester in which all of the hydroxyl groups of the polyol are esterified, or may be a mixture of a partial ester and a complete ester; the polyol ester is preferably a complete ester.

Of the polyol esters, an ester of a hindered alcohol such as neopentyl glycol, trimethylolethane, trimethylolpropane, trimethylolbutane, di-(trimethylolpropane), tri-(trimethylolpropane), pentaerythritol, di-(pentaerythritol), or tri-(pentaerythritol) is more preferable, and an ester of neopentyl glycol, trimethylolethane, trimethylolpropane, trimethylolbutane, or pentaerythritol is still more preferable because such ester is additionally excellent in hydrolytic stability. An ester of pentaerythritol is most preferable because the ester is particularly excellent in compatibility with the refrigerant and hydrolytic stability.

Specific examples of the preferred polyol ester-based compound include: a diester formed of neopentyl glycol and one or two or more fatty acids selected from valeric acid, caproic acid, enanthic acid, caprylic acid, pelargoic acid, capric acid, oleic acid, isopentanoic acid, 2-methylhexanoic acid, 2-ethylpentanoic acid, 2-ethylhexanoic acid, and 3,5,5-trimethylhexanoic acid; a triester formed of trimethylol etane and one or two or more fatty acids selected from valeric acid, caproic acid, enanthic acid, caprylic acid, pelargoic acid, capric acid, oleic acid, isopentanoic acid, 2-methylhexanoic acid, 2-ethylpentanoic acid, 2-ethylhexanoic acid, and 3,5,5-trimethylhexanoic acid; a triester formed of trimethylol propane and one or two or more fatty acids selected from valeric acid, caproic acid, enanthic acid, caprylic acid, pelargoic acid, capric acid, oleic acid, isopentanoic acid, 2-methylhexanoic acid, 2-ethylpentanoic acid, 2-ethylhexanoic acid, and 3,5,5-trimethylhexanoic acid; a triester formed of trimethylol butane and one or two or more fatty acids selected from valeric acid, caproic acid, enanthic acid, caprylic acid, pelargoic acid, capric acid, oleic acid, isopentanoic acid, 2-methylhexanoic acid, 2-ethylpentanoic acid, 2-ethylhexanoic acid, and 3,5,5-trimethylhexanoic acid; a tetraester formed of pentaerythritol and one or two or more fatty acids selected from valeric acid, caproic acid, enanthic acid, caprylic acid, pelargoic acid, capric acid, oleic acid, isopentanoic acid, 2-methylhexanoic acid, 2-ethylpentanoic acid, 2-ethylhexanoic acid, and 3,5,5-trimethylhexanoic acid.

In the present invention, one kind of the polyol ester-based compounds may be used alone, or two or more kinds thereof may be used in combination.

At least one kind of an oxygen-containing compound selected from the polyvinyl ether-based compound, the polyoxyalkylene glycol-based compound, the polycarbonate-based compound, and the polyol ester-based compound described above is preferably used as the synthetic base oil in the refrigerator oil composition of the present invention. It is desirable that the content of such oxygen-containing compound in the base oil be preferably 50% by mass or more, more preferably 70% by mass or more, still more preferably 90% by mass or more, or particularly preferably 100% by mass.

In the present invention, the molecular weight of the synthetic base oil is in the range of preferably 150 to 5,000, or more preferably 500 to 3,000 from the viewpoints of, for example, the suppression of the evaporation of the oil, the flash point of the oil, and the performance of the oil as refrigerator oil.

In the present invention, one containing preferably 50% by mass or less, more preferably 30% by mass or less, or still more preferably 10% by mass or less of any other base oil together with the oxygen-containing compound can be used as the base oil; the base oil is particularly preferably free of any other base oil.

Examples of the base oil that can be used in combination with the oxygen-containing compound include: other polyesters; hydrides of α-olefin oligomers; mineral oil; alicyclic hydrocarbon compounds; and alkylated aromatic hydrocarbon compounds.

A partial ether of a condensate of 4 to 20 molecules of a hindered glycol and/or an aliphatic polyhydric alcohol having 3 to 6 hydroxyl groups is used as a partial hydrocarbyl ether of an aliphatic polyhydric alcohol condensate to be used in combination with the synthetic base oil in the refrigerator oil composition of the present invention.

The term "partial hydrocarbyl ether of an aliphatic polyhydric alcohol condensate" as used herein refers to a state where not all hydroxyl groups present in the aliphatic polyhydric alcohol condensate are etherified, and at least one hydroxyl group remains in a free form without being etherified.

In the present invention, a hindered glycol and an aliphatic polyhydric alcohol having 3 to 6 hydroxyl groups are used as aliphatic polyhydric alcohols as raw materials for the formation of the aliphatic polyhydric alcohol condensate.

Here, the hindered glycol is preferably, for example, neopentyl glycol, and examples of the aliphatic polyhydric alcohol having 3 to 6 hydroxyl groups include glycerin, trimethylolethane, trimethylolpropane, trimethylolbutane, 1,3,5-pentanetriol, pentaerythritol, erythritol, arabitol, sorbitol, and mannitol.

In the present invention, the aliphatic polyhydric alcohol condensate is formed by condensing 4 to 20 molecules of such aliphatic polyhydric alcohol; the condensate is preferably a condensate of 4 to 15 molecules of such alcohol from the viewpoints of, for example, the ease with which the condensate is produced and the performance of a partial hydrocarbyl ether of the condensate. A method for the condensation is not particularly limited, and a conventionally known method can be adopted as the method.

In addition, a method of turning the aliphatic polyhydric alcohol condensate thus formed into a partial hydrocarbyl ether is not particularly limited, and a conventionally known method can be adopted as the method.

A hydrocarbyl group of which a partial hydrocarbyl ether portion of the aliphatic polyhydric alcohol condensate is constituted is, for example, a straight-chain or branched alkyl or alkenyl group having 3 to 25 carbon atoms, a group containing an alicyclic structure having 5 to 25 carbon atoms, an aryl group having 6 to 25 carbon atoms, or an aralkyl group having 7 to 25 carbon atoms. Of those, a straight-chain or branched alkyl or alkenyl group having 3 to 25 carbon atoms is preferable, and a straight-chain or branched alkyl or alkenyl group having 6 to 20 carbon atoms is more preferable from the viewpoint of, for example, the performance of the partial hydrocarbyl ether of the aliphatic polyhydric alcohol condensate to be obtained.

Examples of the alkyl or alkenyl group having 6 to 20 carbon atoms include: alkyl groups including various hexyl groups, octyl groups such as an n-octyl group, a 2-ethylhexyl group, and an iso-octyl group, various decyl groups, various dodecyl groups such as a lauryl group, various tetradecyl groups such as a myristyl group, various hexadecyl groups such as a palmityl group, and octadecyl groups such as a stearyl group and an isostearyl group; and alkenyl groups including various hexenyl groups, various octenyl groups, various decenyl groups, various dodecenyl groups, various tetradecenyl groups, various hexadecenyl groups, and various octadecenyl groups such as an oleyl group.

In the present invention, in terms of, for example, the performance of the refrigerator oil composition, the partial hydrocarbyl ether of the aliphatic polyhydric alcohol condensate is preferably a monoether, and the aliphatic polyhydric alcohol condensate is preferably a glycerin condensate.

A monohydrocarbyl ether of a glycerin condensate is, for example, a compound represented by a general formula (IV):

[Chem 5]

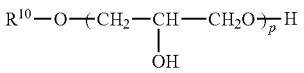

(IV)

where $R^{10}$ represents a straight-chain or branched alkyl or alkenyl group having 3 to 25, or preferably 6 to 20 carbon atoms, and p represents an integer of 4 to 20, or preferably 4 to 15.

Examples of the monohydrocarbyl ether, which is a glycerin condensate represented by the general formula (IV), include tetraglycerin monooleyl ether, hexaglycerin monooleyl ether, decaglycerin monooleyl ether, tetraglycerin monolauryl ether, hexaglycerin monolauryl ether, decaglycerin monolauryl ether, tetraglycerin mono-2-ethylhexyl ether, hexaglycerin mono-2-ethylhexyl ether, decaglycerin mono-2-ethylhexyl ether, tetraglycerin monoisostearyl ether, hexaglycerin monoisostearyl ether, and decaglycerin monoisostearyl ether, but are not limited thereto.

Such partial hydrocarbyl ether of an aliphatic polyhydric alcohol condensate has functions of: reducing the coefficient of friction of the refrigerator oil composition; and improving the energy-saving property of the composition.

In the present invention, one kind of the partial hydrocarbyl ethers of aliphatic polyhydric alcohol condensates may be used alone, or two or more kinds thereof may be used in combination. The content of such partial hydrocarbyl ether is preferably in the range of 0.1 to 10% by mass with reference to the total amount of the composition. When the content is 0.1% by mass or more, the coefficient of friction of the composition reduces, and an improving effect on the energy-saving property of the composition is exerted. In addition, when the content is 10% by mass or less, the solubility of the partial hydrocarbyl ether is not of concern. The content is more preferably 0.2 to 5% by mass, or still more preferably 0.3 to 3% by mass.

At least one kind of an additive selected from an extreme pressure agent, an oiliness agent, an antioxidant, an acid scavenger, a copper deactivator, and an anti-foaming agent can be incorporated into the refrigerator oil composition of the present invention as desired to such an extent that the object of the present invention is not impaired.

Examples of the extreme pressure agent include phosphorus-based extreme pressure agents such as a phosphate, an acid phosphate, a phosphite, an acid phosphite, and amine salts thereof.

Of those phosphorus-based extreme pressure agents, tricresyl phosphate, trithiophenyl phosphate, tri(nonylphenyl) phosphite, dioleyl hydrogen phosphite, 2-ethylhexyldiphenyl phosphite, or the like is particularly preferable in terms of, for example, extreme pressure property and a frictional characteristic.

In addition, the examples of the extreme pressure agent further include metal salts of carboxylic acids. The term "metal salts of carboxylic acids" as used herein preferably refers to metal salts of carboxylic acids each having 3 to 60 carbon atoms, and, further, fatty acids each having 3 to 30, in particular, 12 to 30 carbon atoms. The examples further include metal salts of: dimer acids and trimer acids of the fatty acids; and dicarboxylic acids each having 3 to 30 carbon atoms. Of those, a metal salt of an fatty acid having 12 to 30 carbon atoms or of a dicarboxylic acid having 3 to 30 carbon atoms is particularly preferable.

On the other hand, a metal of which any such metal salt is constituted is preferably an alkali metal or an alkaline earth metal, and, in particular, is optimally an alkali metal.

Further, examples of the extreme pressure agents and extreme pressure agents other than those mentioned above include sulfur type extreme pressure agents such as sulfurized fat, sulfurized fatty acid, sulfurized ester, sulfurized olefin, dihydrocarvyl polysulphide, thiocarbamates, thioterpenes, and dialkyl thiodipropionates.

The blending amount of the above extreme pressure agent is in the range of preferably 0.001 to 5% by mass in ordinary cases, or particularly preferably 0.005 to 3% by mass with reference to the total amount of the composition in terms of lubricity and stability.

One kind of the extreme pressure agents may be used alone, or two or more kinds thereof may be used in combination.

Examples of the oiliness agents include, aliphatic saturated and unsaturated monocarboxylic acids such as stearic acids and oleic acids; polymerized fatty acids such as dimer acids and hydrogenated dimer acids; hydroxy fatty acids such as ricinoleic acids and 12-hydroxystearic acids; aliphatic saturated and unsaturated monohydric alcohols such as lauryl alcohol and oleyl alcohol; aliphatic saturated and unsaturated monoamines such as stearyl amine and oleylamine; aliphatic saturated and unsaturated monocarboxylic acid amides such as lauric acid amide and oleamide; and partial esters of a polyhydric alcohol such as glycerin and sorbitol, and an aliphatic saturated or unsaturated monocarboxylic acid.

One kind thereof may be used alone, or two or more kinds thereof may be used in combination. In addition, the blending amount of the oiliness agent is selected from the range of typically 0.01 to 10% by mass, or preferably 0.1 to 5% by mass with reference to the total amount of the composition.

A phenol-based antioxidant such as 2,6-di-tert-butyl-4-methylphenol, 2,6-di-tert-butyl-4-ethylphenol, or 2,2'-methylenebis(4-methyl-6-tert-butylphenol) or an amine-based antioxidant such as phenyl-α-naphthylamine or N,N'-di-phenyl-p-phenylenediamine is preferably blended as the antioxidant. The antioxidant is blended in the composition at a content of typically 0.01 to 5% by mass, or preferably 0.05 to 3% by mass in terms of, for example, an effect and economical efficiency.

Examples of the acid scavenger include: phenyl glycidyl ether; an alkyl glycidyl ether; an alkylene glycol glycidyl ether; cyclohexeneoxide; an α-olefinoxide; and an epoxy compound such as epoxidized soybean oil. Of those, phenyl glycidyl ether, the alkyl glycidyl ether, the alkylene glycol glycidyl ether, cyclohexeneoxide, or the α-olefinoxide is preferable in terms of compatibility with the refrigerant.

Each of an alkyl group of the alkyl glycidyl ether and an alkylene group of the alkylene glycol glycidyl ether may be branched, and has typically 3 to 30, preferably 4 to 24, or particularly preferably 6 to 16 carbon atoms. In addition, one having a total of generally 4 to 50, preferably 4 to 24, or particularly preferably 6 to 16 carbon atoms is used as the α-olefinoxide. In the present invention, one kind of the above acid scavengers may be used, or two or more kinds thereof may be used in combination. In addition, the blending amount of the acid scavenger is in the range of preferably 0.005 to 5% by mass in ordinary cases, or particularly preferably 0.05 to 3% by mass with reference to the composition in terms of an effect and the suppression of the generation of sludge.

In the present invention, the stability of the refrigerator oil composition can be improved by blending the acid scavenger. The combined use of the extreme pressure agent and the antioxidant with the acid scavenger exerts an additional improving effect on the stability.

The copper deactivator is, for example, N-[N',N'-dialkyl (alkyl group having 3 to 12 carbon atoms)aminomethyl]tolutriazole, and examples of the anti-foaming agent include silicone oil and fluorinated silicone oil.

The refrigerator oil composition of the present invention has a kinematic viscosity of preferably 1 to 500 $mm^2/s$, more preferably 3 to 300 $mm^2/s$, or still more preferably 5 to 200 $mm^2/s$ at 40° C. The composition has a volume specific resistance of preferably $10^9$ Ω·cm or more, or more preferably $10^{10}$ Ω·cm or more, and an upper limit for the volume specific resistance is typically about $10^{11}$ Ω·cm. In addition, the composition has a coefficient of friction by a reciprocating dynamic friction test of typically 0.115 or less, or preferably 0.110 or less, and a lower limit for the coefficient of friction is typically about 0.10.

It should be noted that a method of measuring each of the kinematic viscosity, the volume specific resistance, and the coefficient of friction will be described later.

The refrigerator oil composition of the present invention is used in a refrigerator using, for example, a natural refrigerant such as carbon dioxide, ammonia, propane, butane, or isobutane, a hydrofluorocarbon-based refrigerant such as R410A, R407C, R404A, R134a, or R152a, a fluorine-containing organic compound-based refrigerant such as an unsaturated fluorinated hydrocarbon compound, a fluorinated ether compound, a fluorinated alcohol compound, or a fluorinated ketone compound, a refrigerant obtained by combining the fluorine-containing organic compound-based solvent and a saturated fluorinated hydrocarbon compound, or a refrigerant obtained by combining fluoroiodomethane and propene.

The used amounts of any one of the various refrigerants and the refrigerator oil composition in a method of lubricating a refrigerator using the refrigerator oil composition of the present invention are such that a mass ratio of the refrigerant to the refrigerator oil composition is in the range of preferably 99/1 to 10/90, or more preferably 95/5 to 30/70. An amount of the refrigerant below the above range is not preferable because a reduction in refrigerating capacity of the refrigerator is observed. In addition, an amount of the refrigerant beyond the above range is not preferable either because the lubricity of the composition reduces. The refrigerator oil composition of the present invention, which can be used in any one of various refrigerators, is particularly preferably applicable to the compression refrigerating cycle of a compression refrigerator.

A refrigeration system to which the refrigerator oil composition of the present invention is applied is, for example, a refrigeration system including a compressor, a condenser, an expansion mechanism (a capillary tube or an expansion valve), and an evaporator as essential components, a refrigeration system having an ejector cycle, or a refrigeration system including a drying device (desiccating agent: synthetic zeolite).

The compressor may be any one of an opened compressor, a semi-closed compressor, and a closed compressor, and the motor of the closed compressor is an AC motor or a DC motor.

In addition, a polyethylene terephthalate resin or a polybutylene terephthalate resin is typically used as an insulation material for the refrigeration system.

A water content in the refrigeration system is preferably 500 massppm or less, or more preferably 300 massppm or less. In addition, an air content in the system is preferably 13 kPa or less, or more preferably 1 kPa or less.

Various sliding parts (such as a bearing) are present in a compressor in a refrigerator to which the refrigerator oil composition of the present invention is applied. In the present invention, a part composed of engineering plastic, or a part having an organic or inorganic coating film is used as each of the sliding parts in terms of, in particular, sealing property.

Preferable examples of the engineering plastic include a polyamide resin, a polyphenylene sulfide resin, and a polyacetal resin in terms of, for example, sealing property, sliding property, and abrasion resistance.

In addition, examples of the organic coating film include a fluorine-containing resin coating film (such as a polytetrafluoroethylene coating film), a polyimide coating film, and a polyamideimide coating film in terms of, for example, sealing property, sliding property, and abrasion resistance.

On the other hand, examples of the inorganic coating film include a graphite film, a diamond-like carbon film, a nickel film, a molybdenum film, a tin film, a chromium film, a nitride film, and a boron film in terms of, for example, sealing property, sliding property, and abrasion resistance. The inorganic coating film may be formed by a plating treatment, or may be formed by a chemical vapor deposition method (CVD) or a physical vapor deposition method (PVD).

It should be noted that a part composed of, for example, a conventional alloy system such as an Fe base alloy, an Al base alloy, or a Cu base alloy can also be used as each of the sliding parts.

The refrigerator oil composition of the present invention has a low coefficient of friction, is excellent in energy-saving property, and is suitably used in each of a compression refrigerator and a refrigeration system in various refrigeration fields (such as a car air conditioner, a gas heat pump, an air conditioner, a cold storage, a vending machine, a showcase, a water heater, a floor heating appliance, and a heat pump of a drier for a laundry machine).

EXAMPLES

Next, the present invention will be described in more detail by way of examples. However, the present invention is by no means limited by these examples.

It should be noted that the various characteristics of a refrigerator oil composition obtained in each example were determined by the following methods.

(1) Kinematic Viscosity at 40° C.

The kinematic viscosity of each composition at 40° C. was measured in conformance with JIS K 2283. It should be noted that the kinematic viscosity of base oil was measured in the same manner as that described above.

(2) Volume Specific Resistance

After having been dried under reduced pressure (40 to 100 Pa) at 100° C. for 1 hour, sample oil was charged into a liquid cell for the measurement of a volume specific resistance in a thermostat at 80° C. After the oil had been held in the thermostat at 80° C. for 40 minutes, the volume specific resistance of the oil was measured with a super megohmmeter "R8340" manufactured by ADVANTEST CORPORATION at an applied voltage of 250 V.

(3) Coefficient of Friction

A reciprocating dynamic friction test was performed under the following conditions, and the coefficient of friction of each composition was measured.

<Test Conditions>

| | |
|---|---|
| Test piece: | cylinder SUJ2 (Φ4.5 mm × 5.3 mm)/plate FC250 |
| Load: | 49 N |
| Rate: | 25 mm/s |
| Temperature: | room temperature |
| Stroke: | 10 mm |

(4) Power Consumption Reduction Ratio

Each composition was evaluated for energy-saving property by measuring the power consumption reduction ratio of the composition when actually used in a refrigerator under the following test conditions. The results of the evaluation were shown while the refrigerator oil composition of Comparative Example 1 was defined as reference oil; provided that the refrigerator oil composition of Comparative Example 2 was defined as reference oil in Example 12, the refrigerator oil composition of Comparative Example 3 was defined as reference oil in Example 13, and, similarly, the refrigerator oil composition of Comparative Example 4/5 was defined as reference oil in Example 14/15, respectively.

<Test Conditions>

| | |
|---|---|
| Apparatus: | rotary compressor (three phase-200 V) |
| Discharge pressure: | 2.4 MPa |
| Suction pressure: | 1.37 MPa |
| Frequency: | 30 Hz |
| Test oil: | 420 g |
| R410A refrigerant: | 1,200 g |

(5) Capillary Flow Rate Reduction Ratio

The capillary flow rate reduction ratio of each composition after a test performed under the following conditions was determined.

<Test Conditions>

| | |
|---|---|
| Apparatus: | rotary compressor (three phase-200 V) |
| Discharge pressure: | 3.2 MPa |
| Suction pressure: | 0.7 MPa |
| Discharge temperature: | 100° C. |
| Suction temperature: | 30° C. |
| Test time: | 1,000 hours |
| Capillary: | Φ1.1 mm × 2 m |
| Test oil: | 400 g |
| R410A refrigerant: | 400 g |

(6) Shield Tube Test

A catalyst Fe/Cu/Al was loaded into a glass tube. The tube was filled with sample oil and a refrigerant (R410A) at a ratio "sample oil/refrigerant" of 4 mL/1 ml, sealed, and held at 175° C. for 30 days. After that, the external appearance of the oil, the external appearance of the catalyst, and the presence or absence of sludge were observed, and the acid number of the oil was determined.

Examples 1 to 15 and Comparative Examples 1 to 6

Refrigerator oil compositions each having a composition shown in Table 1 were prepared, and the coefficient of friction, power consumption reduction ratio, and capillary flow rate reduction ratio of each of the compositions were determined. Further, each of the compositions was subjected to a shield tube test. Table 1 shows the results.

TABLE 1

| | | | Example | | | | | |
|---|---|---|---|---|---|---|---|---|
| | | | 1 | 2 | 3 | 4 | 5 | 6 |
| Composition of refrigerator oil composition (% by mass) | Base oil | Kind | A1 | A1 | A1 | A1 | A1 | A1 |
| | | Amount | Balance | Balance | Balance | Balance | Balance | Balance |
| | Polyhydric alcohol ether compound | Kind | B1 | B2 | B3 | B4 | B5 | B6 |
| | | Amount | 1.0 | 1.0 | 1.0 | 1.0 | 1.0 | 1.0 |
| | Extreme pressure agent | | 1.0 | 1.0 | 1.0 | 1.0 | 1.0 | 1.0 |
| | Acid scavenger | | 1.0 | 1.0 | 1.0 | 1.0 | 1.0 | 1.0 |
| | Antioxidant | | 0.5 | 0.5 | 0.5 | 0.5 | 0.5 | 0.5 |
| | Anti-foaming agent | | 0.001 | 0.001 | 0.001 | 0.001 | 0.001 | 0.001 |
| Characteristics of refrigerator oil composition | Kinematic viscosity at 40° C. ($mm^2/s$) | | 68.7 | 67.6 | 67.2 | 67.1 | 67.3 | 67.4 |
| | Volume specific resistance (Ω · cm) | | $0.5 \times 10^{11}$ | $0.3 \times 10^{11}$ | $0.6 \times 10^{11}$ | $0.5 \times 10^{11}$ | $0.4 \times 10^{11}$ | $0.3 \times 10^{11}$ |
| | Coefficient of friction | | 0.108 | 0.107 | 0.106 | 0.108 | 0.107 | 0.106 |
| | Power consumption reduction ratio (%) | | 1.0 | 1.1 | 1.2 | 1.0 | 1.1 | 1.2 |
| | Capillary flow rate reduction ratio (%) | | 3.0 | 3.0 | 3.0 | 3.0 | 3.0 | 3.0 |
| | Shield tube test | External appearance of oil | Good | Good | Good | Good | Good | Good |
| | | External appearance of catalyst | Good | Good | Good | Good | Good | Good |
| | | Presence or absence of sludge | No precipitation | No precipitation | No precipitation | No precipitation | No precipitation | No precipitation |

| | | | Example | | | | |
|---|---|---|---|---|---|---|---|
| | | | 7 | 8 | 9 | 10 | 11 |
| Composition of refrigerator | Base oil | Kind | A1 | A1 | A1 | A1 | A1 |
| | | Amount | Balance | Balance | Balance | Balance | Balance |
| | Polyhydric alcohol | Kind | B7 | B8 | B9 | B10 | B11 |

TABLE 1-continued

| | | | | | | | |
|---|---|---|---|---|---|---|---|
| oil composition (% by mass) | ether compound | Amount | 1.0 | 1.0 | 1.0 | 1.0 | 1.0 |
| | Extreme pressure agent | | 1.0 | 1.0 | 1.0 | 1.0 | 1.0 |
| | Acid scavenger | | 1.0 | 1.0 | 1.0 | 1.0 | 1.0 |
| | Antioxidant | | 0.5 | 0.5 | 0.5 | 0.5 | 0.5 |
| | Anti-foaming agent | | 0.001 | 0.001 | 0.001 | 0.001 | 0.001 |
| Characteristics of refrigerator oil composition | Kinematic viscosity at 40° C. ($mm^2/s$) | | 67.1 | 67.4 | 67.5 | 67 | 67.5 |
| | Volume specific resistance (Ω · cm) | | $0.2 \times 10^{11}$ | $0.2 \times 10^{11}$ | $0.3 \times 10^{11}$ | $0.4 \times 10^{11}$ | $0.3 \times 10^{11}$ |
| | Coefficient of friction | | 0.108 | 0.107 | 0.106 | 0.106 | 0.115 |
| | Power consumption reduction ratio (%) | | 1.0 | 1.1 | 1.2 | 1.2 | 0.4 |
| | Capillary flow rate reduction ratio (%) | | 3.0 | 3.0 | 3.0 | 3.0 | 3.0 |
| | Shield tube test | External appearance of oil | Good | Good | Good | Good | Good |
| | | External appearance of catalyst | Good | Good | Good | Good | Good |
| | | Presence or absence of sludge | No precipitation | No precipitation | No precipitation | No precipitation | No precipitation |

| | | | Example | | | |
|---|---|---|---|---|---|---|
| | | | 12 | 13 | 14 | 15 |
| Composition of refrigerator oil composition (% by mass) | Base oil | Kind | A2 | A3 | A4 | A5 |
| | | Amount | Balance | Balance | Balance | Balance |
| | Polyhydric alcohol ether compound | Kind | B1 | B1 | B1 | B1 |
| | | Amount | 1.0 | 1.0 | 1.0 | 1.0 |
| | Extreme pressure agent | | 1.0 | 1.0 | 1.0 | 1.0 |
| | Acid scavenger | | 1.0 | 1.0 | 1.0 | 1.0 |
| | Antioxidant | | 0.5 | 0.5 | 0.5 | 0.5 |
| | Anti-foaming agent | | 0.001 | 0.001 | 0.001 | 0.001 |
| Characteristics of refrigerator oil composition | Kinematic viscosity at 40° C. ($mm^2/s$) | | 46.5 | 74.8 | 67.3 | 67.9 |
| | Volume specific resistance (Ω · cm) | | $0.5 \times 10^{10}$ | $1.0 \times 10^{10}$ | $0.9 \times 10^{11}$ | $0.4 \times 10^{13}$ |
| | Coefficient of friction | | 0.108 | 0.106 | 0.106 | 0.106 |
| | Power consumption reduction ratio (%) | | 1.1 (With reference to Comparative Example 2) | 1.2 (With reference to Comparative Example 3) | 1.2 (With reference to Comparative Example 4) | 1.2 (With reference to Comparative Example 5) |
| | Capillary flow rate reduction ratio (%) | | 3.0 | 3.0 | 3.0 | 3.0 |
| | Shield tube test | External appearance of oil | Good | Good | Good | Good |
| | | External appearance of catalyst | Good | Good | Good | Good |
| | | Presence or absence of sludge | No precipitation | No precipitation | No precipitation | No precipitation |

| | | | Comparative Example | | | | | |
|---|---|---|---|---|---|---|---|---|
| | | | 1 | 2 | 3 | 4 | 5 | 6 |
| Composition of refrigerator oil composition (% by mass) | Base oil | Kind | A1 | A2 | A3 | A4 | A5 | A1 |
| | | Amount | Balance | Balance | Balance | Balance | Balance | Balance |
| | Polyhydric alcohol ether compound | Kind | — | — | — | — | — | B12 |
| | | Amount | — | — | — | — | — | 1.0 |
| | Extreme pressure agent | | 1.0 | 1.0 | 1.0 | 1.0 | 1.0 | 1.0 |
| | Acid scavenger | | 1.0 | 1.0 | 1.0 | 1.0 | 1.0 | 1.0 |
| | Antioxidant | | 0.5 | 0.5 | 0.5 | 0.5 | 0.5 | 0.5 |
| | Anti-foaming agent | | 0.001 | 0.001 | 0.001 | 0.001 | 0.001 | 0.001 |
| Characteristics of refrigerator oil composition | Kinematic viscosity at 40° C. ($mm^2/s$) | | 68.1 | 46.7 | 75.2 | 68.5 | 67.9 | 67.8 |
| | Volume specific resistance (Ω · cm) | | $1.0 \times 10^{11}$ | $1.0 \times 10^{9}$ | $1.0 \times 10^{10}$ | $1.1 \times 10^{13}$ | $1.0 \times 10^{13}$ | $0.8 \times 10^{11}$ |
| | Coefficient of friction | | 0.122 | 0.130 | 0.115 | 0.118 | 0.119 | 0.121 |
| | Power consumption reduction ratio (%) | | (Reference) | — | — | — | — | 0.0 |
| | Capillary flow rate reduction ratio (%) | | 3.0 | 3.0 | 3.0 | 3.4 | 3.4 | 3.0 |
| | Shield tube | External appearance of oil | Good | Good | Good | Good | Good | Good |

TABLE 1-continued

| | | | | | | | |
|---|---|---|---|---|---|---|---|
| test | External appearance of catalyst | Good | Good | Good | Good | Good | Good |
| | Presence or absence of sludge | No precipitation | No precipitation | No precipitation | No precipitation | No precipitation | No precipitation |

(Notes)
A1: polyvinyl ether (PVE) having a kinematic viscosity of 68.1 $mm^2/s$ at 40° C.
A2: polyoxyalkylene glycol (PAG) having a kinematic viscosity of 46.7 $mm^2/s$ at 40° C.
A3: polyvinyl ether polyalkylene glycol copolymer (mole ratio 1:1) having a kinematic viscosity of 75.2 $mm^2/s$ at 40° C.
A4: polyol ester (POE) having a kinematic viscosity of 68.5 $mm^2/s$ at 40° C.
A5: polycarbonate (PC) having a kinematic viscosity of 67.9 $mm^2/s$ at 40° C.
B1: tetraglycerin monooleyl ether
B2: hexaglycerin monooleyl ether
B3: decaglycerin monooleyl ether
B4: tetraglycerin monolauryl ether
B5: hexaglycerin monolauryl ether
B6: decaglycerin monolauryl ether
B7: tetraglycerin mono-2-ethylhexyl ether
B8: hexaglycerin mono-2-ethylhexeyl ether
B9: decaglycerin mono-2-ethylhexyl ether
B10: hexaglycerin mono-isostearyl ether
B11: tetraglycerin-di-2-ethylhexyl ether
B12: monoglycerin monooleyl ether
Extreme pressure agent: tricresyl phosphate (TCP)
Acid-supplement agent: α-olefin oxide having 14 carbon atoms
Antioxidant: 2,6-di-tert-butyl-4-methyl phenol
Antifoamer: silicone-based antifoamer As can be seen from Table 1, the refrigerator oil composition of the present invention has good stability against a shield tube test, and has a small capillary flow rate reduction ratio (Examples 1 to 15). In addition, the refrigerator oil compositions of Examples 1 to 11 each containing Base Oil A1 and a polyhydric alcohol ether compound of the present invention (any one of B1 to B11) each have a lower coefficient of friction, a higher power consumption reduction ratio, and a higher energy-saving effect than those of the refrigerator oil composition of Comparative Example 1 free of such polyhydric alcohol ether compound. Similarly, the refrigerator oil compositions of Examples 12 to 15 each containing any one of Base Oils A2 to A5 and the polyhydric alcohol ether compound of the present invention each have a better energy-saving effect than that of each of the refrigerator oil compositions of Comparative Examples 2 to 5 from each of which the polyhydric alcohol ether compound of the present invention is removed.

In contrast, nearly no reduction in coefficient of friction or power consumption is observed in the refrigerator oil composition of Comparative Example 6 in which the polyhydric alcohol ether compound of the present invention is replaced with monoglycerin monooleyl ether, and the composition is not observed to have an energy-saving effect.

INDUSTRIAL APPLICABILITY

The refrigerator oil composition of the present invention has a low coefficient of friction, is excellent in energy-saving property, and is suitably used in each of a refrigerator and a refrigeration system in various refrigeration fields (such as a car air conditioner, a gas heat pump, an air conditioner, a cold storage, a vending machine, a showcase, a water heater, a floor heating appliance, and a heat pump of a drier for a laundry machine).

The invention claimed is:

1. A refrigerator oil composition, comprising:
a synthetic base oil; and
a partial hydrocarbyl ether of an aliphatic polyhydric alcohol condensate, wherein the aliphatic polyhydric alcohol condensate comprises a condensate of 4 to 20 molecules of a hindered glycol and/or an aliphatic polyhydric alcohol having 3 to 6 hydroxyl groups, and
wherein the content of the partial hydrocarbyl ether is in the range of 0.1 to 10% by mass with reference to the total mass of the composition.

2. A refrigerator oil composition according to claim 1, wherein the synthetic base oil comprises at least one compound selected from a polyvinyl ether-based compound, a polyoxyalkylene glycol-based compound, a polycarbonate-based compound, and a polyol ester-based compound.

3. A refrigerator oil composition according to claim 1, wherein the synthetic base oil has a molecular weight of 150 to 5,000.

4. A refrigerator oil composition according to claim 1, wherein the partial hydrocarbyl ether of the aliphatic polyhydric alcohol condensate comprises a monoether.

5. A refrigerator oil composition according to claim 1, wherein the aliphatic polyhydric alcohol condensate comprises a glycerin condensate.

6. A refrigerator oil composition according to claim 1, wherein a hydrocarbyl group of which a hydrocarbyl ether portion in the partial hydrocarbyl ether of the aliphatic polyhydric alcohol condensate is constituted comprises an alkyl or alkenyl group having 3 to 25 carbon atoms.

7. A refrigerator oil composition according to claim 1, wherein a content of the partial hydrocarbyl ether of the aliphatic polyhydric alcohol condensate is 0.2 to 10% by mass with reference to a total amount of the composition.

8. A refrigerator oil composition according to claim 1, further comprising at least one kind of an additive selected from an extreme pressure agent, an oiliness agent, an antioxidant, an acid scavenger, a copper deactivator, and an antifoaming agent.

9. A refrigerator oil composition according to claim 1, wherein the composition has a kinematic viscosity of 1 to 500 mm 2/s at 40° C., a volume specific resistance of 109 Ω·cm or more, and a coefficient of friction by a reciprocating dynamic friction test of 0.115 or less.

10. A refrigerator oil composition according to claim 1, wherein a content of the partial hydrocarbyl ether of the aliphatic polyhydric alcohol condensate is 0.3 to 10% by mass with reference to a total amount of the composition.

11. A refrigerator oil composition according to claim 1, wherein a content of the partial hydrocarbyl ether of the aliphatic polyhydric alcohol condensate is 0.2 5% by mass with reference to a total amount of the composition.

12. A refrigerator oil composition according to claim 1, wherein a content of the partial hydrocarbyl ether of the aliphatic polyhydric alcohol condensate is 0.3 to 3% by mass with reference to a total amount of the composition.

13. A refrigerator oil composition according to claim 4, wherein a content of the partial hydrocarbyl ether of the aliphatic polyhydric alcohol condensate is 0.3 to 10% by mass with reference to a total amount of the composition.

14. A refrigerator oil composition according to claim 4, wherein a content of the partial hydrocarbyl ether of the aliphatic polyhydric alcohol condensate is 0.2 to 5% by mass with reference to a total amount of the composition.

15. A refrigerator oil composition according to claim 4, wherein a content of the partial hydrocarbyl ether of the aliphatic polyhydric alcohol condensate is 0.3 to 3% by mass with reference to total amount of the composition.

* * * * *